US006817070B1

(12) United States Patent
Liu

(10) Patent No.: US 6,817,070 B1
(45) Date of Patent: Nov. 16, 2004

(54) SHOELACE FASTENER

(75) Inventor: Kun-Chung Liu, No. 5, Alley 9, Lane 212, San-Feng Rd., Hou-Li Hsiang, Taichung Hsien (TW)

(73) Assignee: Kun-Chung Liu, Taichung (TW)

( * ) Notice: Subject to any disclaimer, the term of this patent is extended or adjusted under 35 U.S.C. 154(b) by 0 days.

(21) Appl. No.: 10/625,931

(22) Filed: Jul. 23, 2003

(51) Int. Cl.[7] ..... A43B 11/00; A43C 7/00; F16G 11/14

(52) U.S. Cl. ..... 24/712.5; 24/712.1; 24/712.9; 24/713; 24/713.6; 24/714; 24/712.6; 36/50.1

(58) Field of Search ..... 24/712.5, 712.1, 24/712.2, 712.3, 712.6, 712.9, 713, 713.6, 714, 714.6, 115 G; 36/50.1

(56) References Cited

U.S. PATENT DOCUMENTS 4,817,250 A * 4/1989 Kurosaki ..... 24/115 G
5,097,573 A * 3/1992 Gimeno ..... 24/712.5
5,903,959 A * 5/1999 Leonardi ..... 24/712.1
6,003,214 A * 12/1999 Lee ..... 24/712.1
6,094,787 A * 8/2000 Chang ..... 24/712.1
6,571,438 B2 * 6/2003 Liu ..... 24/712.5

* cited by examiner

*Primary Examiner*—Victor Sakran
(74) *Attorney, Agent, or Firm*—Merchant & Gould P.C.

(57) ABSTRACT

A shoelace fastener is provided for a shoe that includes a shoelace having a pair of distal lace segments. The shoelace fastener includes a fastener body formed with a pair of through holes. Each of a pair of clamp members has a pivot portion partitioning a respective through hole into a lace entry side and a lace exit side. The distal lace segments are extendable through the lace entry side, over a respective clamp member, and into the lace exit side of a respective through hole in the fastener body. Tension applied by the shoe on the shoelace enables the clamp members to clamp the distal lace segments against the fastener body. Pulling of the fastener body through a pull unit results in loosening of the shoe.

8 Claims, 7 Drawing Sheets

SHOELACE FASTENER

BACKGROUND OF THE INVENTION

1. Field of the Invention

The invention relates to a shoe accessory, more particularly to a shoelace fastener for maintaining a tightened state of a shoe.

2. Description of the Related Art

In U.S. Pat. No. 6,571,438, there is disclosed a double-bow shoelace device that is adapted to be mounted on a shoe and that includes a shoelace, a clamp member, and an assembly of two loops and a decorative knot. The shoelace has a first lace segment that is strung on the shoe, and a second lace segment that includes first and second lace portions, each of which has a lower end connected to the first lace segment. The clamp member is sleeved slidably on at least one of the lace portions, and includes an elongate casing, a clamping block slidably received in the casing, and a biasing member disposed in the casing for biasing the clamping block to a lace clamping position. Downward and upward movements of the clamp member along at least one of the lace portions result in tightening and loosening of the shoe. The assembly is disposed on and externally of the clamp member.

Although the aforesaid shoelace device serves the purpose of tightening and loosening of the shoe, there are some drawbacks associated therewith. Particularly, because the clamping block of the clamp member must be forced inwardly into the casing against the biasing action of the biasing member when it is desired to loosen the shoe, the overall size of the clamp member must be large enough for the fingers of the user to press the clamping block and the clamp member toward each other. The relatively large clamp member has an adverse affect on the appearance of the shoe. It is also noted that the assembly of the loops and the knot on the clamp member is merely for decorative purposes, and does not have any practical function associated therewith.

FIG. 1 illustrates another conventional shoelace fastener 3 for a shoelace 4 having a pair of distal lace portions 402. The fastener 3 includes a plate body formed with an inner pair of lace entry holes 301 and an outer pair of lace exit holes 302. Two resilient clamp members 303 extend integrally from the plate body into the lace exit holes 302, respectively. In use, the distal lace portions 402 are first extended through the lace entry holes 301 and are subsequently extended through the lace exit holes 302. The clamp members 303 clamp the distal lace portions 402 against the plate body of the fastener 3. Although the aforesaid shoelace fastener 3 also serves the purpose of tightening and loosening of a shoe (not shown), there are still some drawbacks associated therewith. Particularly, since the fastener 3 must be pulled upwardly when it is desired to loosen the shoe, the lack of a pull component on the fastener 3 makes it difficult to conduct the pulling operation. Moreover, the size of the fastener 3 must be relatively large in order to facilitate upward pulling of the same.

SUMMARY OF THE INVENTION

Therefore, the object of the present invention is to provide a shoelace fastener that can overcome the aforesaid drawbacks associated with the prior art.

According to the present invention, there is provided a shoelace fastener for a shoe that includes a shoe body with a pair of eyelet tabs, and a shoelace strung on the eyelet tabs and having a pair of distal lace segments. The shoelace fastener comprises a fastener body, a pair of clamp members, and a pull unit secured on and disposed externally of the fastener body.

The fastener body is formed with a pair of through holes that are arranged in a first direction. Each of the through holes has a hole axis transverse to the first direction. Each of the clamp members has a pivot portion pivotable relative to the fastener body about a respective pivot axis that extends in a second direction transverse to the first direction and the hole axes. The pivot portion of each of the clamp members partitions the respective one of the through holes into a lace entry side and a lace exit side respectively proximate to and distal from the other of the through holes. Each of the clamp members further has a clamp portion that extends from the pivot portion.

In use, each of the distal lace segments is extendable through the lace entry side of a respective one of the through holes, over a respective one of the clamp members, and into the lace exit side of the respective one of the through holes. Tension applied by the eyelet tabs upon the shoelace forces the clamp members to clamp the distal lace segments against the fastener body for maintaining a tightened state of the shoe. A manual pulling force applied on the fastener body through the pull unit results in relative movement between the fastener body and at least one of the clamp members to permit sliding movement of at least one of the distal lace segments for loosening the shoe accordingly.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
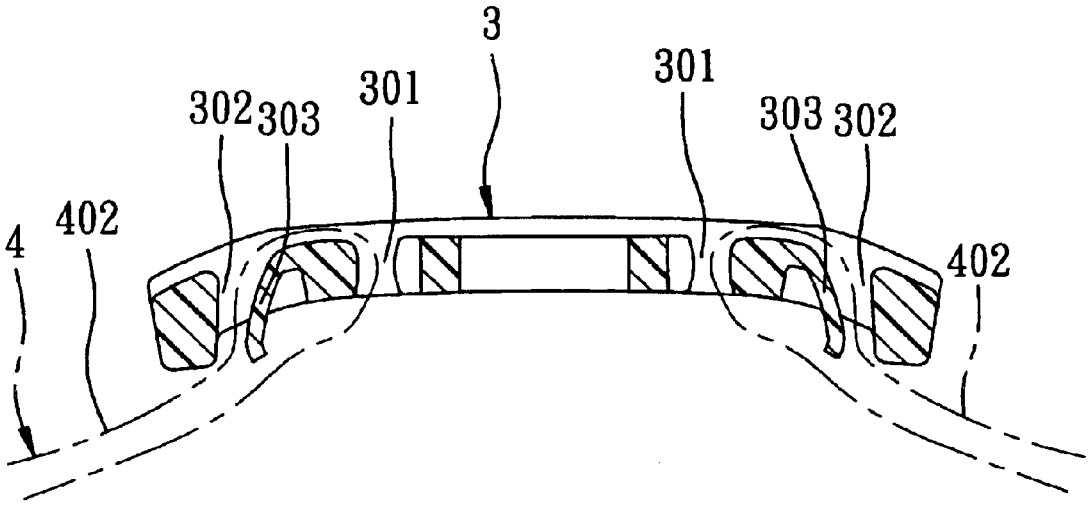
FIG. 1 PRIOR ART
FIG. 1 is a sectional view of a conventional shoelace fastener.
Figure 2:
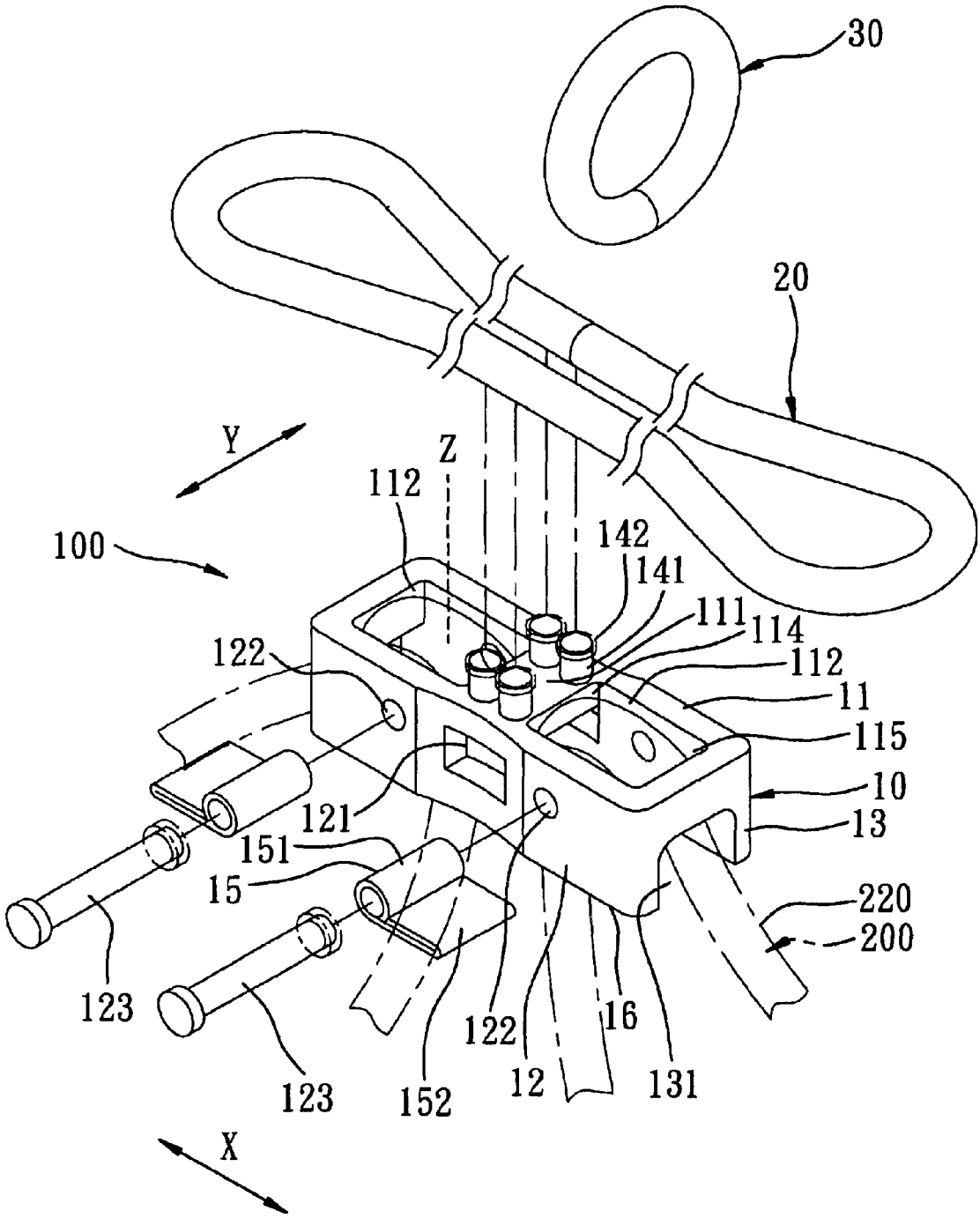
FIG. 2 is an exploded perspective view of the first preferred embodiment of a shoelace fastener according to the present invention.

Referring to FIGS. 2 to 5, the first preferred embodiment of a shoelace fastener 100 according to the present invention is shown to be adapted for use with a shoe that includes a shoe body 300 with a pair of eyelet tabs 310, and a shoelace 200 having an anchoring segment 210 strung on the eyelet tabs 310, and a pair of distal lace segments 220, each of which is connected to the anchoring segment 210 at one end. The shoelace fastener 100 includes a fastener body 10, a pair of clamp members 15, a pull unit 20, and a covering band 30. It should be noted herein that, except for FIG. 5, the shoelace fastener 100 is not drawn to scale in the accompanying drawings and is actually illustrated in a magnified form for the sake of clarity.

Figure 5:
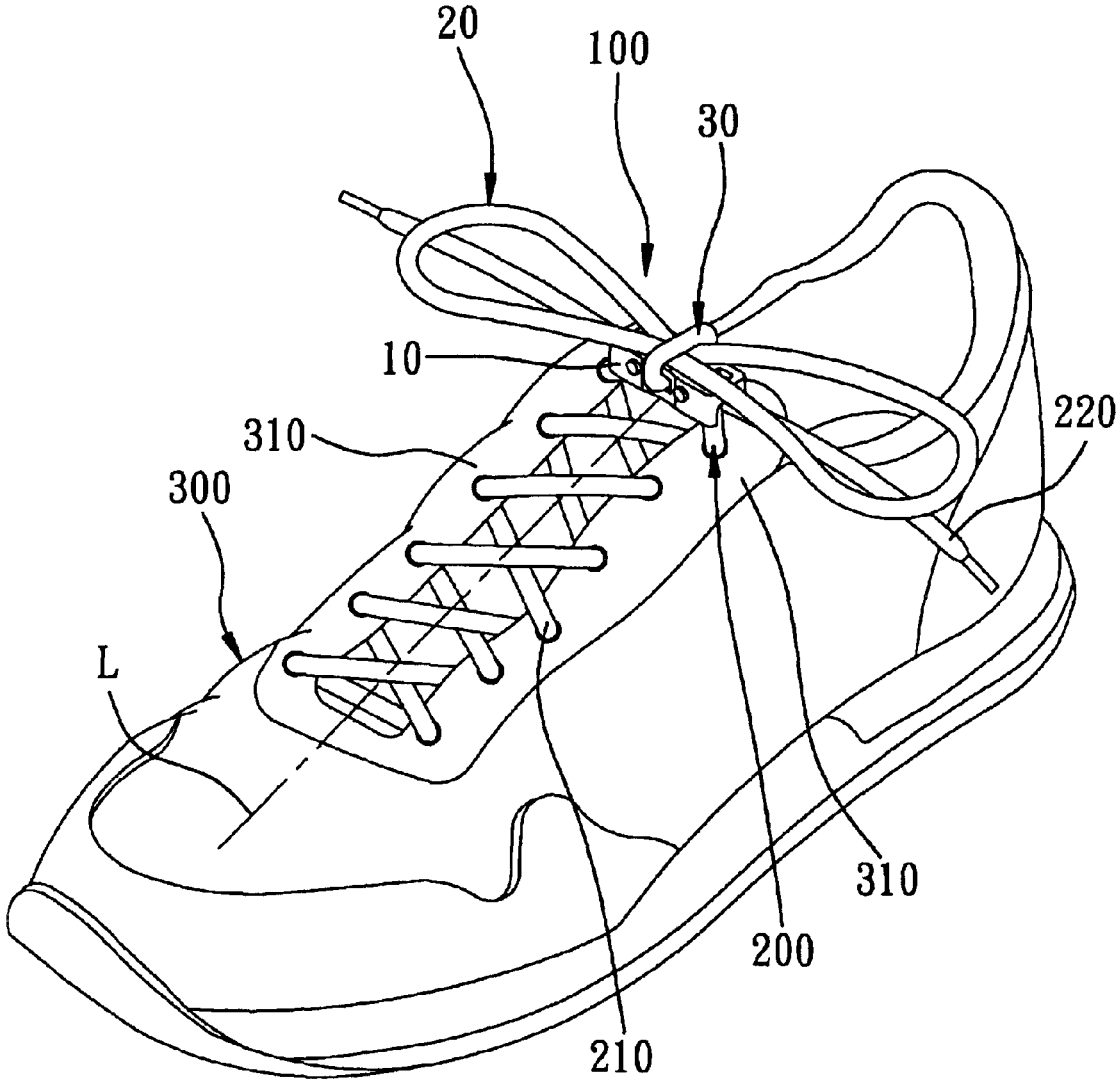
FIG. 5 is a perspective view showing a shoe that incorporates the first preferred embodiment of this invention.

The fastener body 10 has top and bottom sides 11, 16, a pair of longer side walls 12 that extend in a first direction (X) and that extend between the top and bottom sides 11, 16, and a pair of shorter side walls 13 that interconnect the longer side walls 12 and that extend in a second direction (Y) transverse to the first direction (X). The fastener body 10 is formed with a pair of through holes 112 that are arranged in the first direction (X) and that are formed through the top and bottom sides 11, 16 of the fastener body 10. Each of the through holes 112 has a hole axis (Z) that is transverse to the first and second directions (X, Y). In use, a middle plane (L) of the fastener body 10, which is parallel to the second direction (Y), is disposed between the eyelet tabs 310 of the shoe body 300, as best shown in FIG. 5.

Each of the longer side walls 12 is formed with a band hole 121 registered with the middle plane (L), and a pair of pivot holes 122 disposed on opposite sides of the band hole 121. The longer side walls 12 have a pair of pivot axles 123 that extend therebetween and that respectively define a pivot axis extending in the second direction (Y). Each pivot axle 123 has opposite ends retained in an aligned pair of the pivot holes 122 in the longer side walls 12.

Each of the clamp members 15 is disposed in a respective one of the through holes 112, and has a tubular pivot portion 151 that is sleeved on a respective one of the pivot axles 123 and that is pivotable relative to the fastener body 10 about the pivot axis defined by the respective pivot axle 123. The pivot portion 151 of each of the clamp members 15 partitions the respective one of the through holes 112 into a lace entry side 114 and a lace exit side 115 respectively proximate to and distal from the other of the through holes 112.

The fastener body 10 further has a pair of lace notches 131 formed respectively in the shorter side walls 13. The lace notches 131 are aligned in the first direction (X), extend from the bottom side 16 of the fastener body 10, and are in spatial communication with the lace exit side 115 of a respective one of the through holes 112.

Each of the clamp members 15 further has a clamp portion 152 that extends from the pivot portion 151 toward a respective one of the shorter side walls 13.

The pull unit 20 of this embodiment is an endless loop that is preferably made of the same material as the shoelace 200 and that cooperates with the distal lace segments 220 of the shoelace 200 to form a double-bow configuration.

The top side 11 of the fastener body 10 has a mounting portion 111 disposed between the through holes 112. The mounting portion 111 has an outer wall surface formed with a set of retaining studs 141 that pierce through the pull unit 20 and that are subsequently melted to form the retaining studs 141 with enlarged heads 142, thereby retaining the pull unit 20 on the mounting portion 111.

Figure 4:
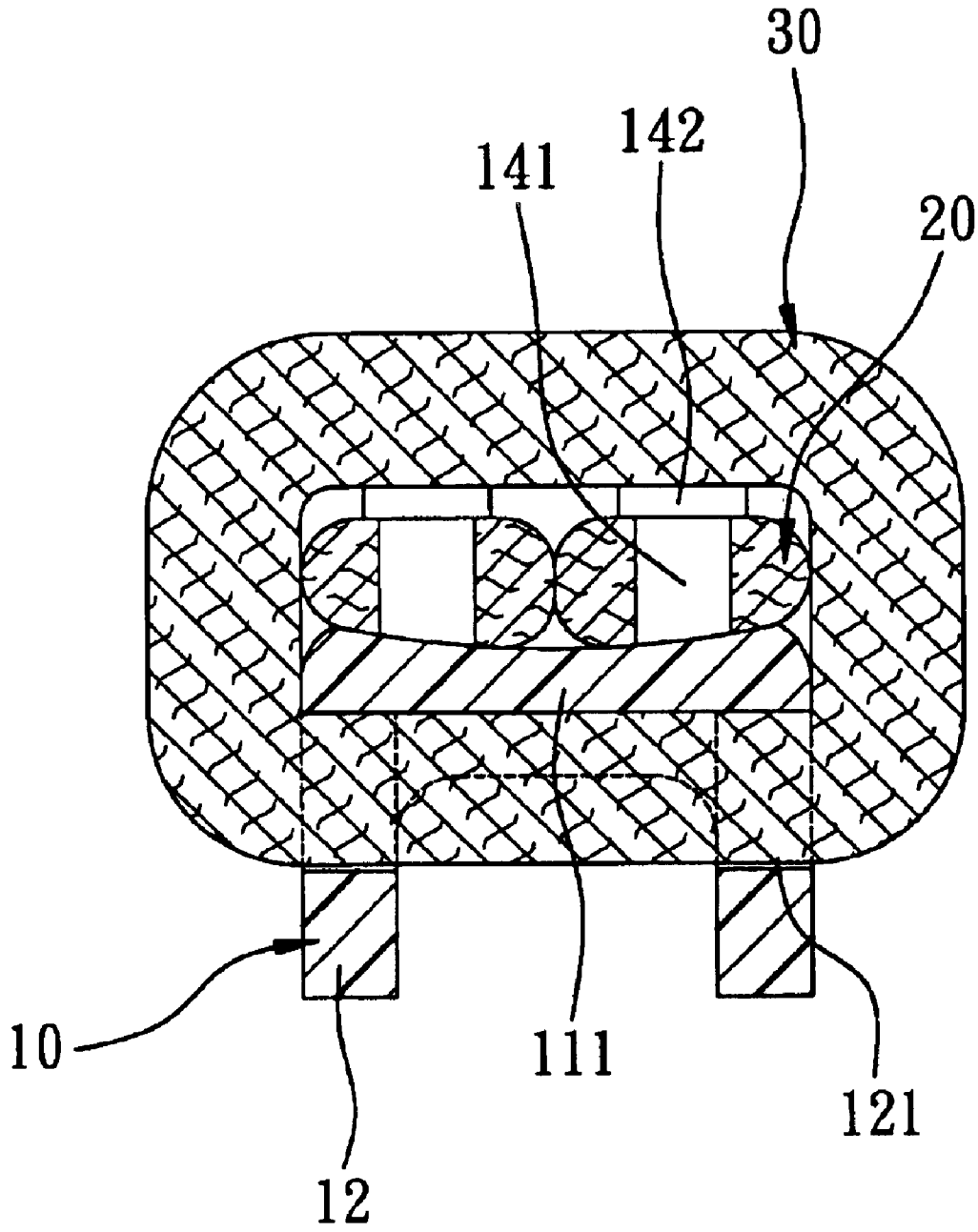
FIG. 4 is a sectional view of the first preferred embodiment, taken along lines 4—4 in FIG. 3.

The covering band 30, which is retained on the fastener body 10 and which is preferably made of the same material as the shoelace 200, extends through the band holes 121 in the longer side walls 12 and above the mounting portion 111 of the top side 11 of the fastener body 10 so as to conceal the retaining studs 141 on the mounting portion 111, as best shown in FIG. 4.

Figure 3:
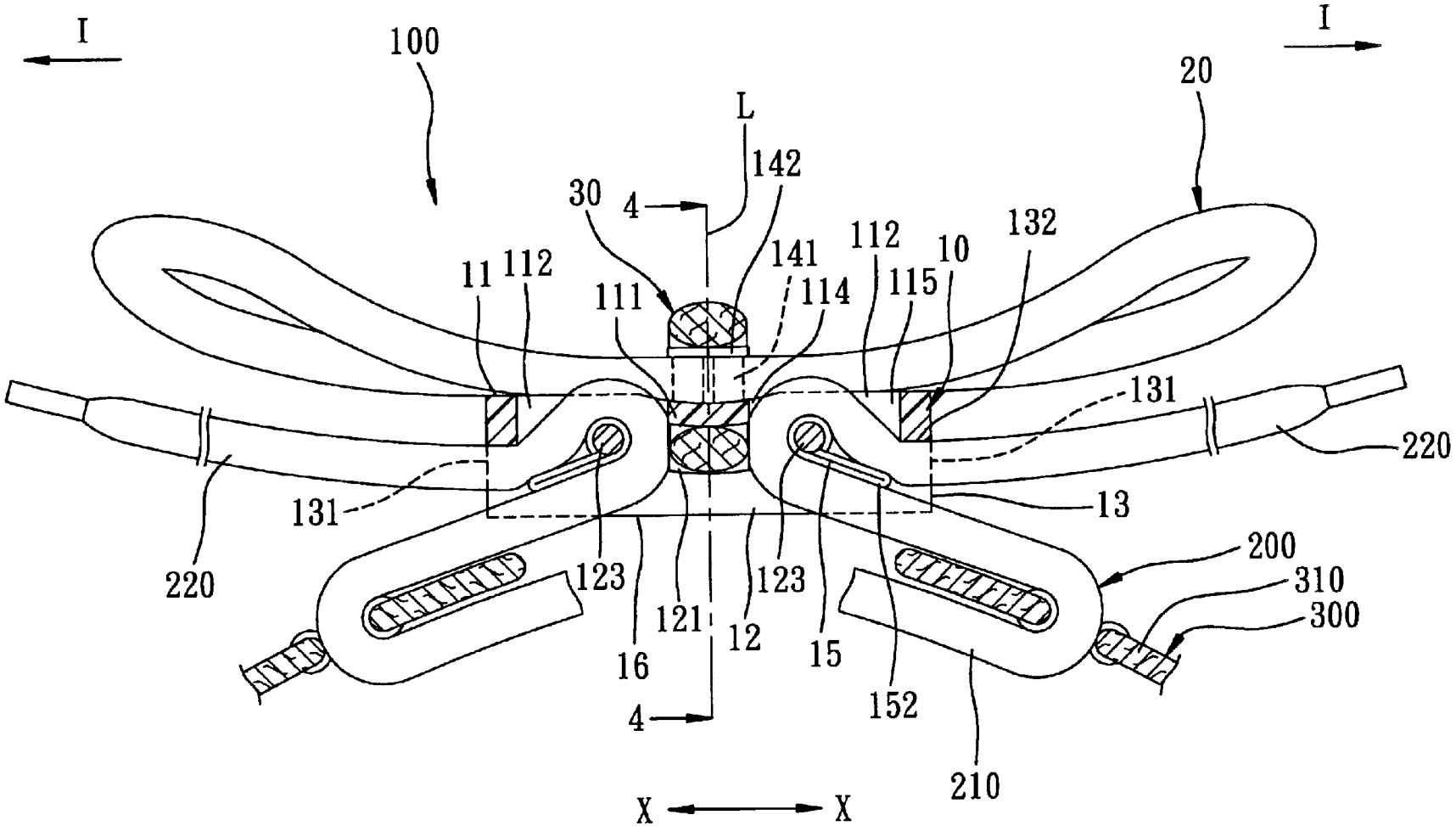
FIG. 3 is a schematic assembled sectional view of the first preferred embodiment to illustrate a tightening operation of a shoe that incorporates the first preferred embodiment.

As shown in FIGS. 3 and 5, in use, each of the distal lace segments 220 is extended through the lace entry side 114 of a respective one of the through holes 112, over the clamp member 15 in the respective one of the through holes 112, into the lace exit side 115 of the respective one of the through holes 112, and out of a respective one of the lace notches 131. At this time, the pull unit 20, the covering band 30 and the distal lace segments 220 cooperate to form a double-bow configuration. After a foot (not shown) is slipped into the shoe body 300, the distal lace segments 220 can be pulled apart from each other as indicated by the arrows (I) in FIG. 3 to tighten the shoe body 300. When the shoe body 300 is tightened, the eyelet tabs 310 are forced apart by the foot in the shoe body 300, thereby applying tension on the shoelace 200. At this time, the clamp members 15 are forced by the respective distal lace segment 220 to pivot upwardly in the respective through hole 112 such that the distal lace segments 220 are clamped between the clamp portions 152 of the clamp members 15 and upper edges 132 (see FIG. 3) of the lace notches 131 in the fastener body 10, thereby maintaining the tightened state of the shoe body 300.

Figure 6:
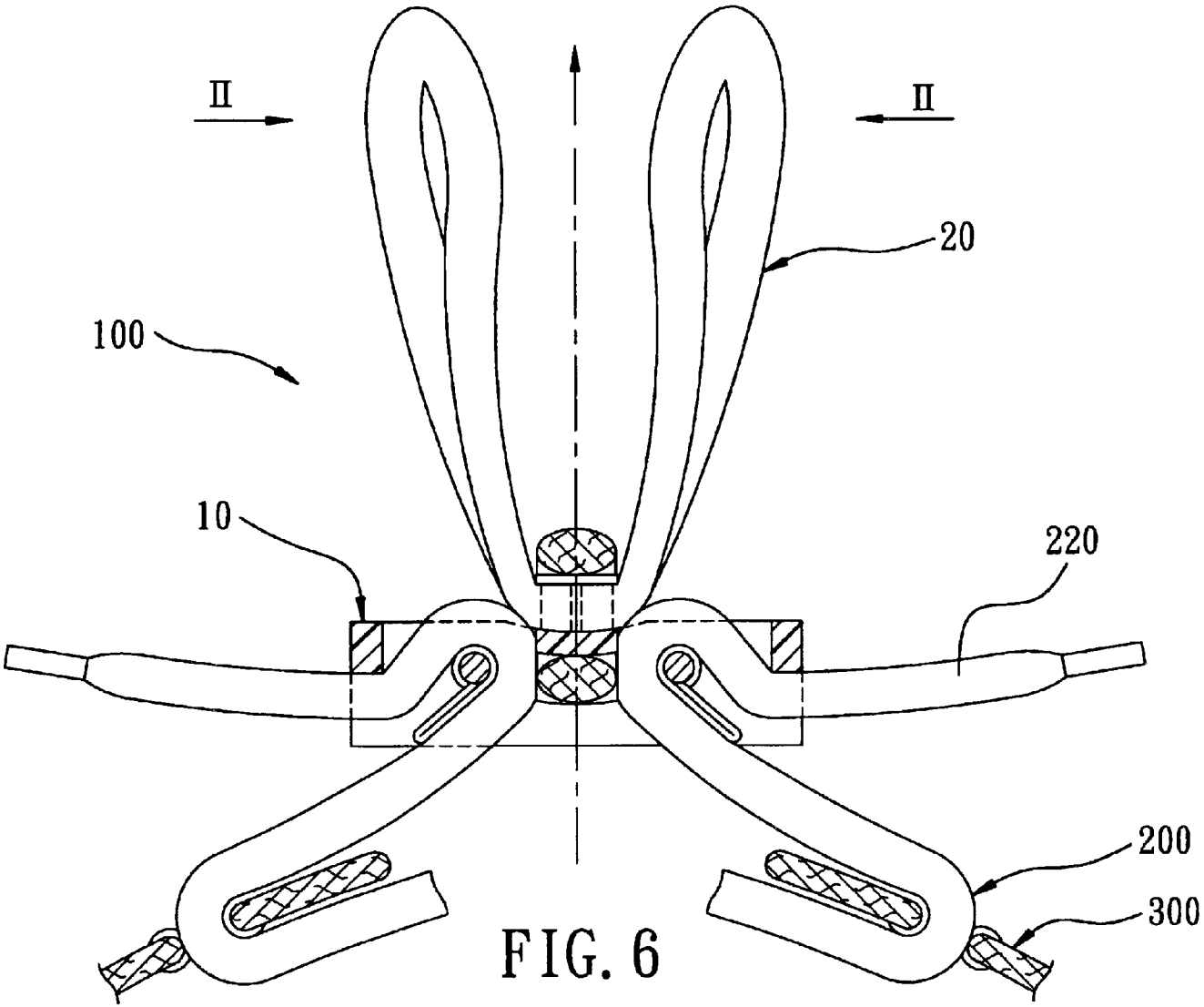
FIG. 6 is a view similar to FIG. 3, illustrating a loosening operation of the shoe.

As shown in FIG. 6, to loosen the shoe body 300, a manual pulling force is applied on the fastener body 10 through the pull unit 20 to move the fastener body 10 upwardly. This results in relative movement between the fastener body 10 and the clamp members 15, which releases the distal lace segments 220 from being clamped by the clamp members 15 against the fastener body 10 so as to permit sliding movement of the distal lace segments 220 as indicated by the arrows (II) in FIG. 6 for loosening the shoe body 300 accordingly.

Figure 7:
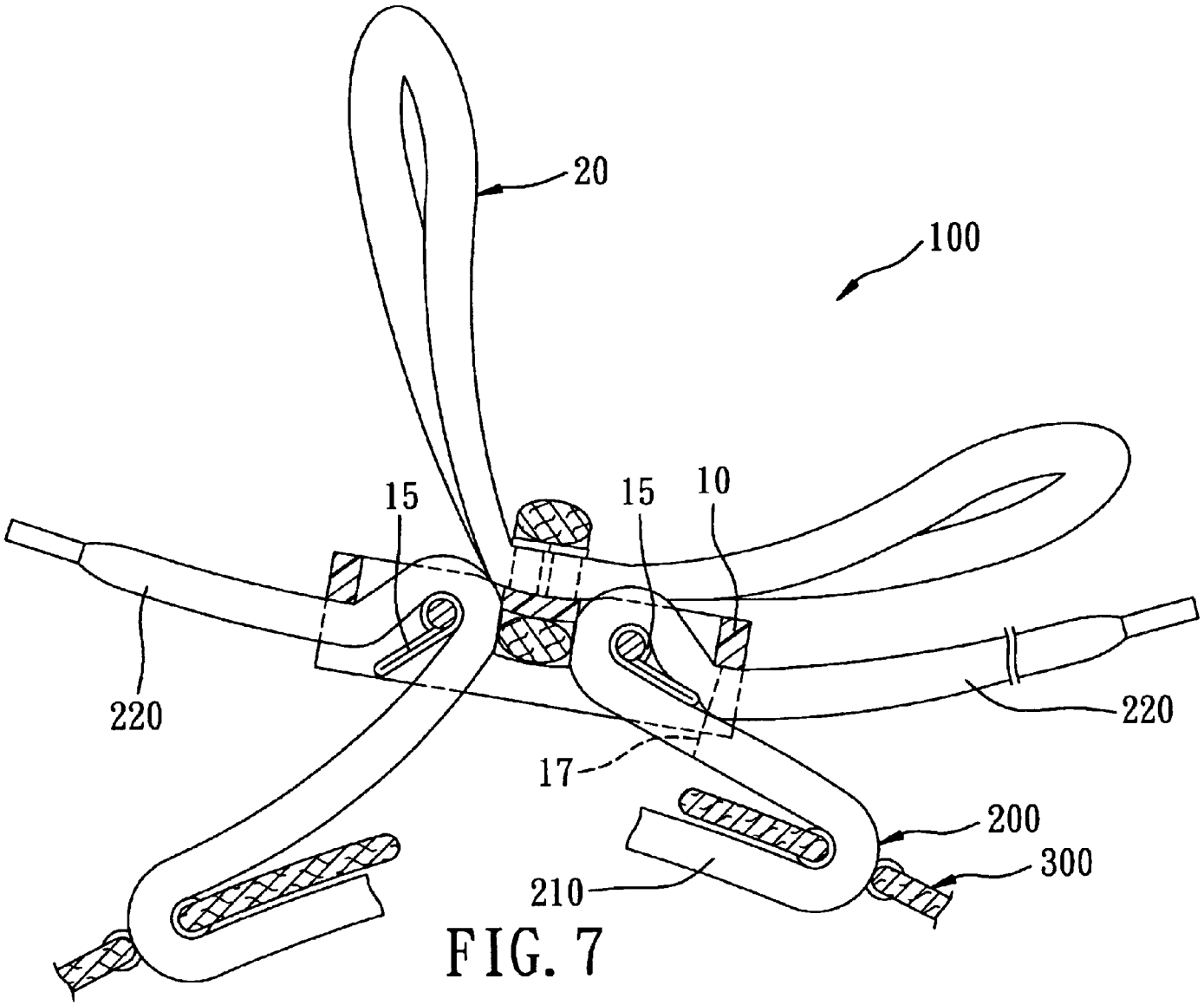
FIG. 7 is a schematic assembled sectional view of the second preferred embodiment of a shoelace fastener according to the present invention.

FIG. 7 illustrates the second preferred embodiment of a shoelace fastener 100 according to this invention, which is a modification of the previous embodiment. Unlike the first preferred embodiment, the shoelace fastener 100 of this embodiment further includes a fixing unit 17 in the form of a stitch seam that is provided on one of the distal lace segments 220 for fixing the latter on the respective one of the clamp members 15. Tightening of the shoe body 300 is accomplished by pulling at the other of the distal lace segments 220. Moreover, when an upward pulling force is exerted on the pull unit 20, only the other of the distal lace segments 220 will be permitted to slide for loosening the shoe body 300.

In sum, the shoelace fastener 100 of the present invention is easy to operate in view of the presence of the pull unit 20. Moreover, since there is no need to hold the fastener body 10 when it is desired to loosen a shoe, the size of the fastener body 10 can be designed to be smaller as compared to the prior art so as not to result in an adverse affect on the appearance of the shoe.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A shoelace fastener for a shoe, the shoe including a shoe body with a pair of eyelet tabs, and a shoelace strung on the eyelet tabs and having a pair of distal lace segments, said shoelace fastener comprising:

a fastener body formed with a pair of through holes that are arranged in a first direction, each of said through holes having a hole axis transverse to the first direction;

a pair of clamp members, each of which has a pivot portion pivotable relative to said fastener body about a respective pivot axis that extends in a second direction transverse to the first direction and the hole axes, said pivot portion of each of said clamp members partitioning the respective one of said through holes into a lace entry side and a lace exit side respectively proximate to and distal from the other of said through holes, each of said clamp members further having a clamp portion that extends from said pivot portion; and a pull unit secured on and disposed externally of said fastener body;

whereby each of the distal lace segments is extendable through said lace entry side of a respective one of said through holes, over a respective one of said clamp members, and into said lace exit side of the respective one of said through holes;

whereby tension applied by the eyelet tabs upon the shoelace forces said clamp members to clamp the distal lace segments against said fastener body for maintaining a tightened state of the shoe; and whereby a manual pulling force applied on said fastener body through said pull unit results in relative movement between said fastener body and at least one of said clamp members to permit sliding movement of at least one of the distal lace segments for loosening the shoe accordingly.

2. The shoelace fastener as claimed in claim 1, wherein said fastener body has top and bottom sides, a pair of longer side walls that extend in the first direction between said top and bottom sides, and a pair of shorter side walls that interconnect said longer side walls and that extend in the second direction, said through holes being formed through said top and bottom sides of said fastener body, said longer side walls having a pair of pivot axles that extend therebetween, said pivot portions of said clamp members being sleeved on said pivot axles, respectively.

3. The shoelace fastener as claimed in claim 2, wherein said clamp portion of each of said clamp members extends towards a respective one of said shorter side walls, each of said shorter side walls being formed with a lace notch that extends from said bottom side of said fastener body.

4. The shoelace fastener as claimed in claim 2, wherein said top side of said fastener body has a mounting portion disposed between said through holes, said mounting portion having an outer wall surface formed with at least one retaining stud that pierces through said pull unit and that is formed with an enlarged head for retaining said pull unit on said mounting portion.

5. The shoelace fastener as claimed in claim 4, further comprising a covering band retained on said fastener body for concealing said at least one retaining stud on said mounting portion of said fastener body.

6. The shoelace fastener as claimed in claim 4, wherein said pull unit is an endless loop that cooperates with the distal lace segments to form a double-bow configuration.

7. The shoelace fastener as claimed in claim 4, wherein said pull unit is made of the same material as the shoelace.

8. The shoelace fastener as claimed in claim 1, further comprising a fixing unit adapted for fixing one of the distal lace segments on the respective one of said clamp members.

* * * * *